United States Patent [19]

Dawson et al.

[11] 4,095,556

[45] Jun. 20, 1978

[54] APPARATUS FOR PAINTING CODING MARKINGS ON ARTICLES

[75] Inventors: Wayne G. Dawson, 757 3rd St., McFarland, Calif. 93250; Robert A. Kozlowski, Garden Grove; Paul W. Beiber, McFarland, both of Calif.

[73] Assignee: Wayne G. Dawson, McFarland, Calif.

[21] Appl. No.: 796,195

[22] Filed: May 12, 1977

[51] Int. Cl.[2] ..... B05C 1/02; B05C 13/02

[52] U.S. Cl. ..... 118/230; 118/219; 118/233

[58] Field of Search ..... 118/218, 219, 230, 233, 118/620, 641; 101/40

[56] References Cited

U.S. PATENT DOCUMENTS

| | | | |
|---|---|---|---|
| 1,485,066 | 2/1924 | Bricken | 118/230 X |
| 1,677,587 | 7/1928 | English | 118/230 X |
| 2,701,545 | 2/1955 | Scherer | 118/219 |
| 2,737,886 | 3/1956 | Ruppel | 101/40 X |
| 2,994,263 | 8/1961 | Rus | 101/40 X |
| 3,323,492 | 6/1967 | Mellar et al. | 118/620 |
| 3,735,732 | 5/1973 | Vanderschoot | 118/230 |

*Primary Examiner*—John P. McIntosh
*Attorney, Agent, or Firm*—Wills, Green & Mueth

[57] ABSTRACT

A machine for painting coding stripes on watch spring bars or other similar articles and which includes a rotary transporting structure preferably turning about a horizontal axis and mounted to receive the articles to be painted successively at an upper pick-up location and progressively advance the articles downwardly to a second location at which painting means form stripes on the articles, with ultimate delivery of the painted articles to a collection point, and with the transporting structure desirably including two wheels which are relatively axially adjustable to receive and hold articles of different lengths.

11 Claims, 16 Drawing Figures

APPARATUS FOR PAINTING CODING MARKINGS ON ARTICLES

BACKGROUND OF THE INVENTION

This invention relates to an improved machine for painting markings on a series of articles to code them for easy visual identification of articles having different sizes or other characteristics.

In copending application Ser. No. 760,965 filed Jan. 21, 1977, there has been disclosed a color coding system for watch spring bars of the type utilized in attaching a strap to a wrist watch. In the arrangement of that prior application, different numbers of painted stripes, of different colors, are employed to identify watch spring bars of different sizes and types. The stripes are formed on the elongated bodies of the spring bar units, which bodies carry spring pressed pins projecting from the opposite ends of the bodies for attachment to the watch case.

SUMMARY OF THE INVENTION

A major purpose of the present invention has been to provide a machine which is capable of painting such coding markings on watch spring bars. As will be apparent from the subsequent detailed description of a preferred form of our machine, the invention in its broadest aspects can also be applied to the painting of coding markings on other articles having structures similar to watch spring bars, such as for example electrical resistors, capacitors, or other electrical components. For simplicity of discussion, the invention will be described primarily hereinafter as applied to the painting of watch spring bars.

A unit embodying the invention includes a transporting unit which is mounted to turn about a predetermined axis, and which is constructed to engage and hold the articles to be painted. Feeding apparatus delivers the articles to the transporter unit at a predetermined pick-up location, to be advanced from that location by the transporter unit to a second location at which painting means apply the desired paint to the articles. The transporter unit preferably turns about a generally horizontal axis, and desirably receives the articles at a location higher than that axis and then moves them downwardly as they approach the painting location. At the painting location, the articles may roll by gravity radially outwardly away from the axis of transporter structure, in a relation urging the articles against the painting element.

The transporter is adjustable to receive and hold spring bars or other articles of different lengths, and for this purpose may include two spaced wheels which are relatively axially adjustable to different spaced relationships for receiving the different sizes of articles. A feed guide for delivering the articles to the transporter structure is desirably mounted for vibratory movement, and may project downwardly between the two non-rotating plates associated with the wheels respectively, with guides of different widths being selectively usable for handling the different sizes of articles.

Certain particular features of the invention relate to improved means for separating from the spring bars or other articles being handled any individual springs, pins or other separated parts which may be unintentionally mixed in with the items being painted. For this purpose, the articles may be moved past a magnet which is strong enough to attract and hold the individual separated parts but not to hold a complete article. Also, the items being painted can be moved over a gap which is dimensioned to allow the separated parts to fall downwardly therethrough but will not pass the assembled items.

BRIEF DESCRIPTION OF THE DRAWINGS

The above and other features and objects of the invention will be better understood from the following detailed description of the typical embodiment illustrated in the accompanying drawings in which.

DESCRIPTION OF THE PREFERRED EMBODIMENT

Figure 8:
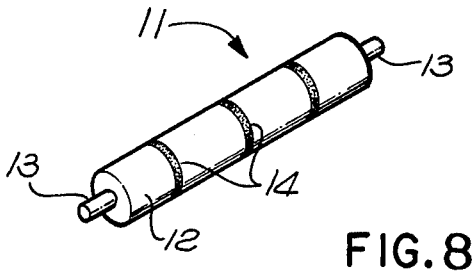
FIG. 8 is a perspective view of one of the watch spring bars which is painted by the apparatus of the present invention.

The machine 10 of the present invention is illustrated as applied to the painting of stripes on a series of watch spring bar units 11, one of which is illustrated in enlarged form in FIG. 8. As seen in that figure, each of these spring bars has an elongated tubular externally cylindrical body 12 from whose opposite ends a pair of axially aligned pins 13 project in opposite directions. These pins are yieldingly urged axially outwardly by a coil spring contained within body 12. The spring bars 11 come in different axial lengths and different diameters, with some of the bars having two shoulders at each end and some having a single shoulder at each end. The length and the type and diameter of bar is identified by provision of one or more color coded stripes 14 extending circularly about the periphery of body 12. The purpose of the present apparatus is to form these stripes on the spring bars.

Figure 1:
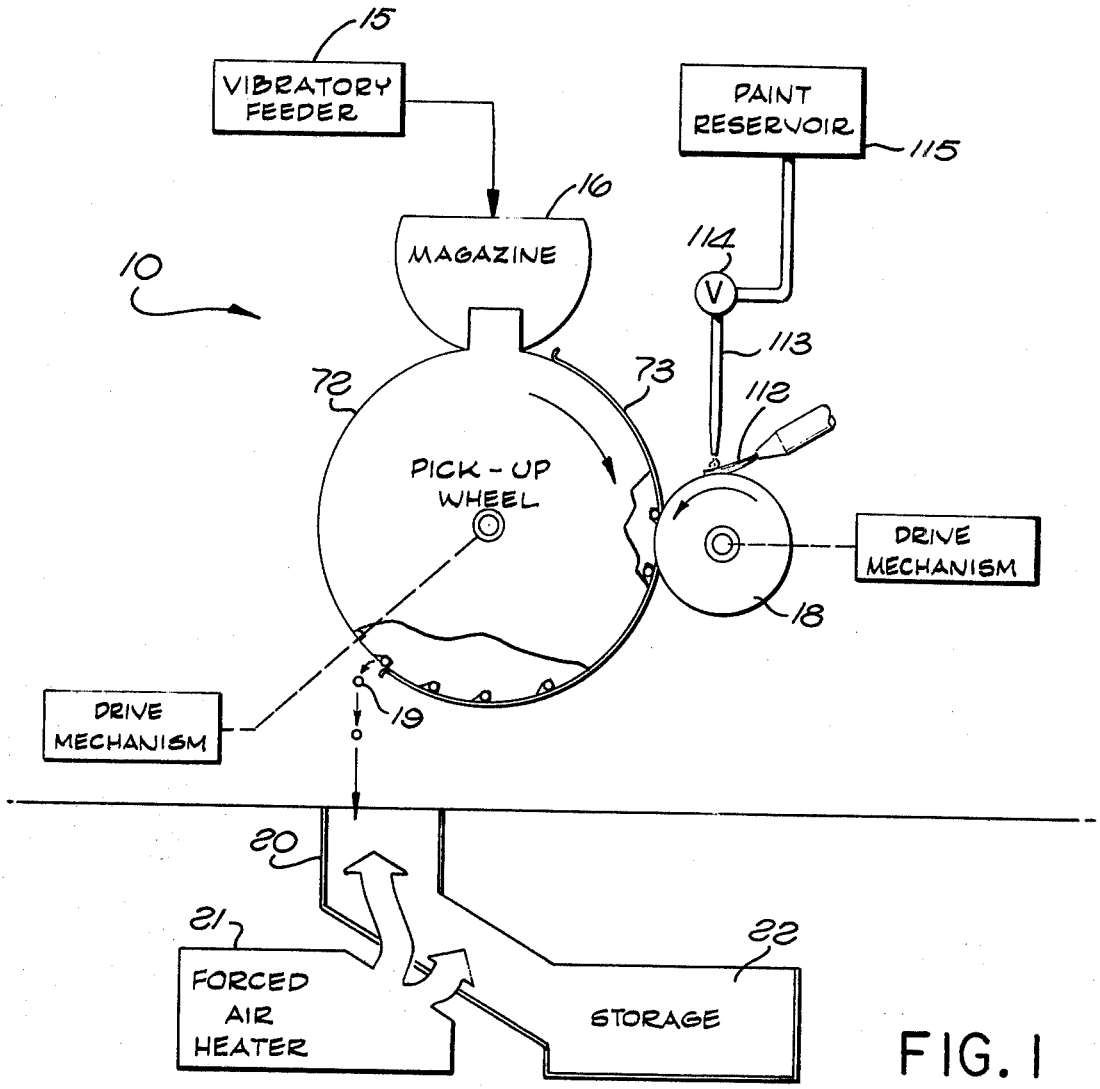
FIG. 1 is a diagrammatic representation of a painting machine constructed in accordance with the invention.

Referring now to FIG. 1, which illustrates the present painting machine diagrammatically, it will be seen from that figure that the machine includes a vibratory feeder 15 which delivers the spring bars to a hopper or magazine 16 in a predetermined proper relative orientation, with the bars 11 being taken sequentially from the bottom of hopper 16 by a transporting unit 17 which delivers the spring bars to the location of a painting wheel 18 by which the stripes are applied. After circular advancement to a location 19, the spring bars are discharged from transporter 17, to fall downwardly into a chute 20 within which the paint is further dried by air from a forced air heater 21, for ultimate accumulation in a storage bin 22.

Figure 10:
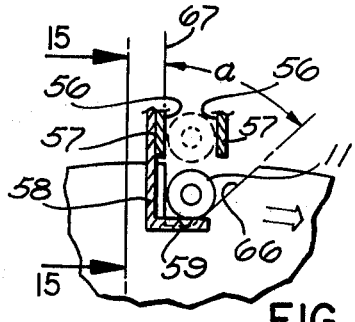
FIG. 10 is an enlarged fragmentary vertical section taken on line 10—10 of FIG. 5, through a lower portion of the feed hopper.
Figure 7:
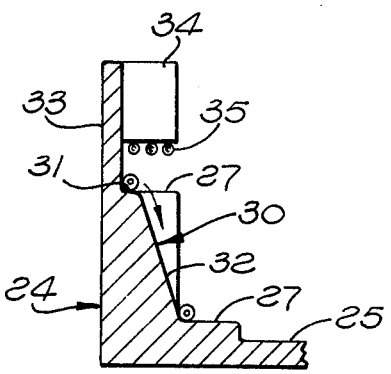
FIG. 7 is an enlarged fragmentary vertical section taken on line 7—7 of FIG. 2.
Figure 9:
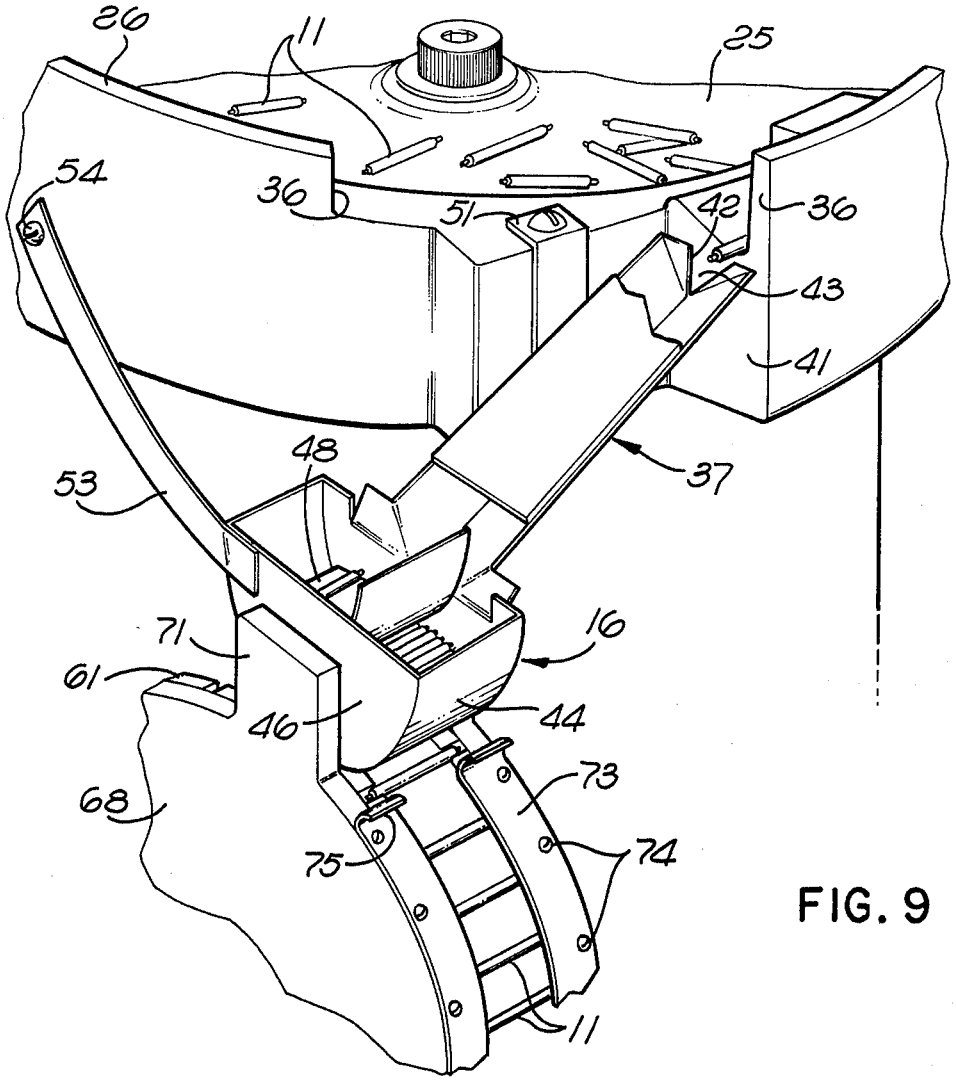
FIG. 9 is a fragmentary perspective view of a portion of the machine.

As seen best in FIG. 9, the vibratory feeder 15 may be of a conventional well known type having an externally cylindrical hollow vertical body 23 appropriately mounted to and projecting upwardly above a horizontal base 24 of the machine, and carrying a circular top head 24 which is vibrated at a controllable frequency and amplitude by electrically energized vibrating means contained within body 23. The head 25 has a horizontal upwardly facing surface 25 on which a supply of identical spring bars 11 are placed, with an esentially circular rim 26 projecting upwardly about the periphery of horizontal surface 25. At the inside of rim 26, there is formed an upwardly facing helical ramp surface 27, which advances gradually upwardly from a location 28 (FIG. 2) to an elevated discharge location 29. At the location 28, the lowermost portion of the ramp is at a level corresponding to that of upper surface 25, so that the spring bars 11 can successfully move onto this lower portion 28 of the ramp and be gradually advanced upwardly along the ramp as seen in FIG. 10 until they ultimately reach the point 29. As will be understood, the vibratory movement of head 24 is such as to cause the described advancement of the spring bars 11 helically upwardly along the ramp, with the bars being in longitudinal alignment with one another as they advance upwardly and as they reach the highest point 29. Just prior to their arrival at the discharge location 29, the spring bars pass a region at which a cutaway or recess 30 is formed in the ramp (FIGS. 2 and 7), to provide a portion 31 of the ramp surface which is so narrow that it can pass the spring bars in only single file relation, so that if a pair of bars happen at any time to reach this location in side by side relation, one of the bars will fall downwardly along the inclined surface 32 of cutaway region 30 and to a lower portion of the ramp 27, thereby assuring that only one bar reaches the point 29 at a time.

Just beyond the cutaway region 30, the upwardly projecting peripheral wall 33 of vibratory head 24 carries a permanent magnet 34, which is spaced a short distance above the upper surface of the ramp at that discharge location, and which has a magnetic force strong enough to pull upwardly any spring bar components which may be mixed in with the complete spring bars and reach the upper end of the ramp in unassembled condition. For example, if any springs, pins, or bodies of the spring bar units reach that location, they are pulled upwardly by the magnet to the location represented at 35 in FIG. 7, and are held at that location until manually removed therefrom. The force of the magnet, though great enough to lift these unassembled components of the spring bar units from the ramp, is not great enough to lift the assembled spring bars from the ramp, but permits them to pass beyond the location of the magnet unaffected.

Figure 2:
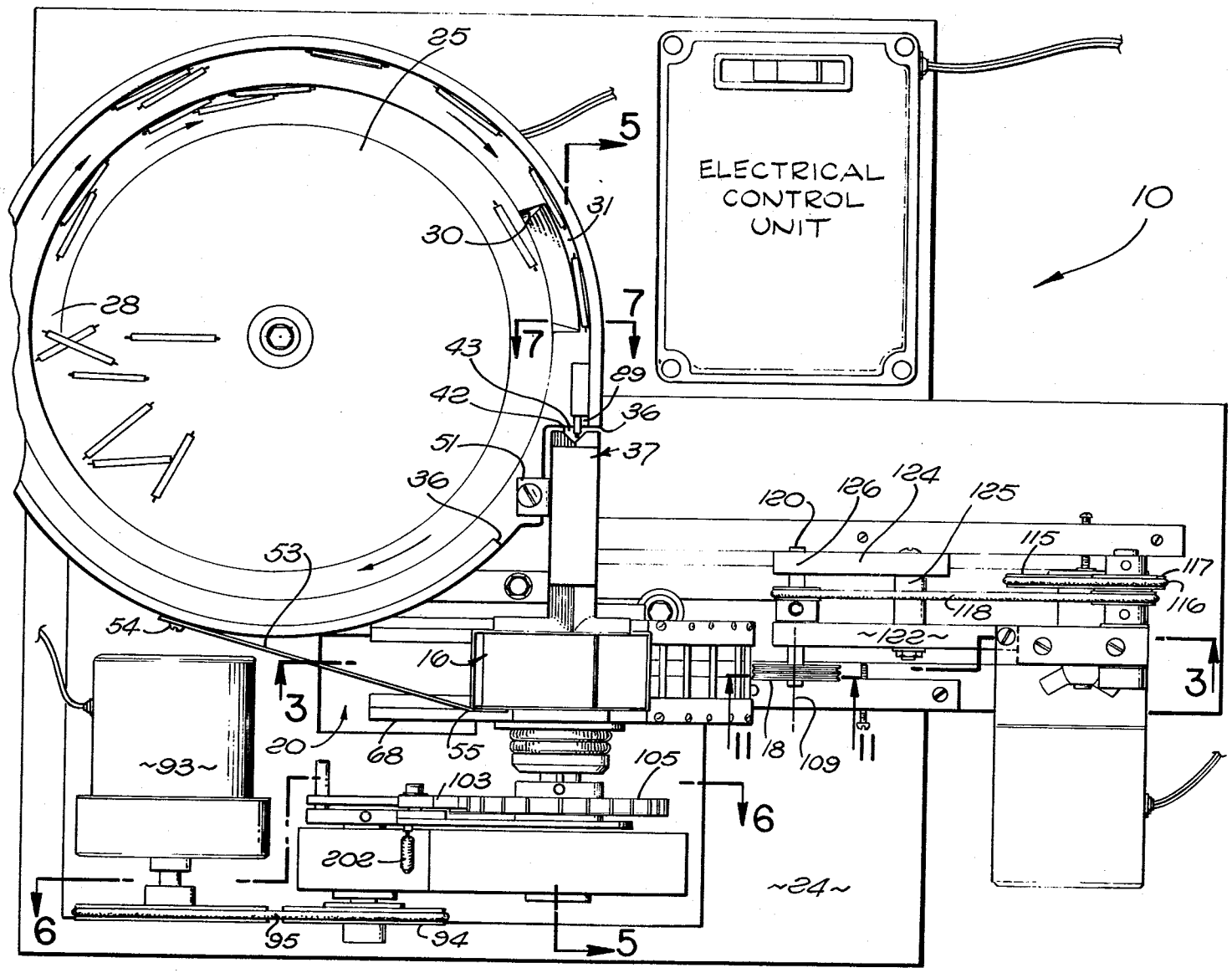
FIG. 2 is a top plan view of a machine embodying the invention.
Figure 3:
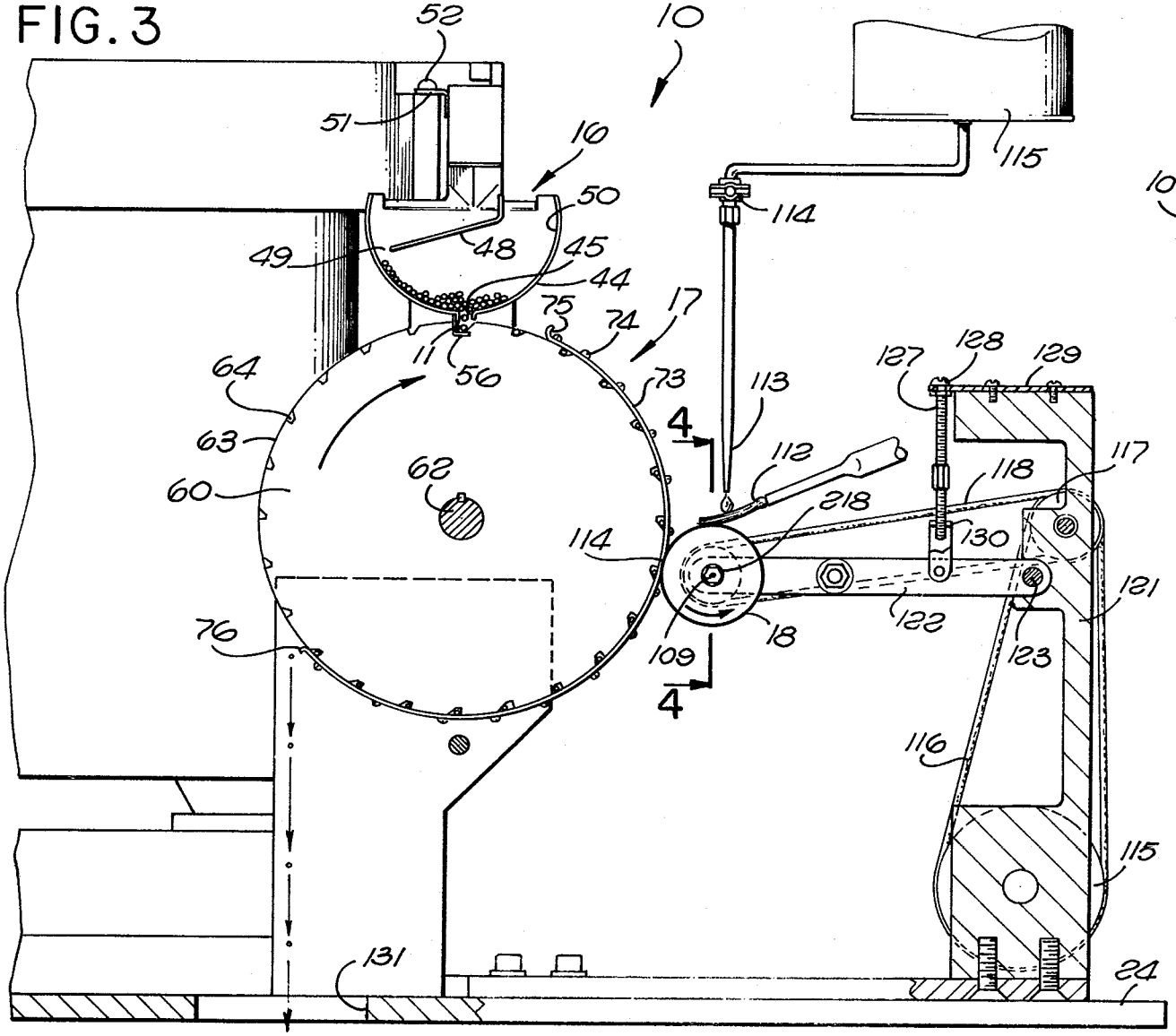
FIG. 3 is a fragmentary vertical section taken on line 3—3 of FIG. 2.
Figure 14:
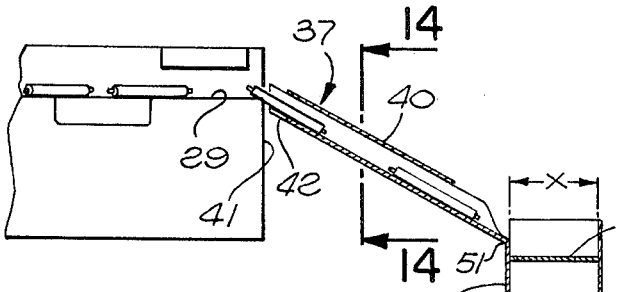
FIG. 14 is an enlarged vertical section taken on line 14—14 of FIG. 5.
Figure 14:
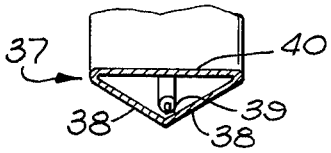

As each of the spring bars moves beyond the location 29 of FIG. 2, the bar is fed by the vibratory motion through a notch 36 formed in the previously mentioned upwstanding peripheral wall 33 of the vibratory head. In leaving the upper end of the ramp surface, the spring bar enters the upper end of an inclined chute 37 whose lower end is connected to hopper 16 within which the spring bars are accumulated in aligned parallel relation as seen in FIG. 3. The chute 14 may be formed of sheet metal or the like, and have two relatively angularly disposed downwardly converging bottom walls 38 forming at their juncture a V-shaped guideway groove 39 along which the spring bars slide downwardly in longitudinally aligned relation. The top of this V-shaped structure may be closed by an upper wall 40 of the chute.

Adjacent the upper end of chute 37, the vibratory head 24 may have a vertical surface 41 (FIG. 5), past which the spring bars move as they discharge from the end portion 29 of ramp 27. The bottom walls 38 of chute 37 are cut away at 42 (FIGS. 2 and 5), to form a typically V-shaped notch as seen best in FIG. 2, leaving a gap of substantial size between the upper edges of the bottom walls of chute 37 and vertical surface 41 at the discharge edge of the vibratory head. The gap 43 is long enough to allow any disassembled springs or pins which may reach that location to fall downwardly therethrough, but is shorter than the axial length of an assembled spring bar unit so that these assembled units can move easily past the gap and into the upper end of the chute.

The hopper 16 is attached to the lower end of chute 37, and has a bottom wall 44 (see FIG. 3), which directs the spring bars 11 downwardly to a discharge location at which an elongated opening 45 is provided by it at the lowermost portion of the hopper, of a width to pass the spring bars downwardly one at a time. A pair of vertical parallel side walls 46 and 47 form with bottom wall 44 a chamber for receiving the spring bars in the parallel relation illustrated in FIGS. 3 and 5, with the wall 46 and 47 being spaced apart a distance $x$ just slightly greater than the axial length of the particular type of spring bar being handled in the equipment. A wall 48 extends between these opposite side walls 46 and 47 at a location above bottom wall 44, and is inclined downwardly as seen in FIG. 3 to receive the spring bars sequentially from the lower end of chute 37, and direct them downwardly to a location 49 at which they fall into the compartment 50 beneath wall 48. The side wall 47 of hopper 16 is connected directly to the lower end of the chute as represented at 51 in FIG. 5, so that the chute 37 and hopper 16 form together a unit, which is attached to the vibratory head 24 for vibration therewith. For this purpose, an angle bracket 51 (FIGS. 2 and 3) is permanently secured to chute 37 near its upper end, and is detachably connectible to the vibratory head by a screw 52 extending through an opening in the upper horizontal portion of bracket 51. Additional attachment of the chute and hopper unit to the vibratory head is made by connection of a strap 53 formed of metal or the like to the vibratory head by a screw 54, with the opposite end 55 of the strap being appropriately secured permanently to hopper 16.

These two screws 52 and 54 thus detachably secure the unit consisting of chute 37 and hopper 16 to the vibratory head in a manner giving this unit very slight vibratory motion with the head, to thus assure advancement of the spring bars downwardly through the chute and within the hopper to the lower discharge location 45. A number of these chute and hopper units are provided for the machine, with the hoppers of the different units having different axial widths $x$ corresponding to lengths of different types of spring bars which may be handled. Thus, whenever the machine is to be used for a certain length of spring bar, the operator merely attaches to the vibratory head by screws 52 and 54 the appropriately dimensioned chute and hopper unit, having a hopper 16 with the proper width dimension *x*.

Figure 15:
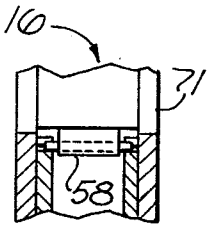
FIG. 15 is a vertical section taken on line 15—15 of FIG. 10.

As each spring bar falls downwardly from the bottom of the hopper at the location 45, the bar passes through a narrow gap 56 (FIG. 10) between two parallel walls 57 which extend downwardly from the bottom of the hopper, with the rear one of these walls carrying an L-shaped supporting element 58 having a bottom horizontal portion 59 which supports a lowermost one of the spring bars 11 at the position illustrated in FIG. 10. As seen in FIG. 15, the width of the L-shaped element 58 is less than the axial length of the individual spring bars, and less than the dimension *x* of the hopper, to allow the opposite ends of the spring bars to project beyond this element 58 for engagement with the transporter 17.

The transporter 17 includes two spaced similar rotating discs or wheels 60 and 61 (FIGS. 3 and 5), which are mounted to turn in unison about a common horizontal axis 62 which is parallel to the direction in which the axes of the spring bar units 11 extend in hopper 16. This axis 62 is therefore perpendicular to the planes of the vertical side walls 46 and 37 of hopper 16. The two wheels 60 and 61 have outer circular peripheral surfaces 63 of a common diameter (FIGS. 3 and 5), each containing a series of evenly circularly spaced notches 64 aligned with the corresponding notches of the other wheels. These notches 64 have the shape illustrated in FIGS. 10 to 13, defined by trailing sides 65 of the notches which extend essentially directly radially with respect to axis 62, and by second sides 66 of the notches at their leading sides and extending at a substantial angle *a* with respect to a true radial line 67. The notches are large enough to allow reception of the opposite ends of the body 12 of a spring bar unit 11 within the corresponding notches of the two wheels, in a relation enabling limited relative movement of the spring bar radially of the wheel structures, as between the broken line and the full line positions of FIG. 11, while the spring bar in its entirety remains radially inwardly of the diameter of outer surfaces 63 of the two wheels 60 and 61.

As seen in FIGS. 10 and 15, the L-shaped element 58 which supports the lowermost spring bar 11 at the bottom of hopper 16 projects downwardly between the two wheels 60 and 61, so that when those wheels turn to a position in which a pair of the notches 64 of the two wheels are directly beneath the bottom of the hopper, the lowermost spring bar 11 from the hopper can fall downwardly into those notches as seen in FIG. 10, and then be advanced rightwardly away from the element 58 as the wheels turn in a clockwise direction. Thus, the wheels successively move the spring bars individually from the location 45 of FIG. 3 to the location of the painting wheel 18.

Figure 16:
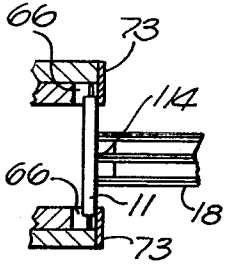
FIG. 16 is a section taken on line 16—16 of FIG. 11.
Figure 5:
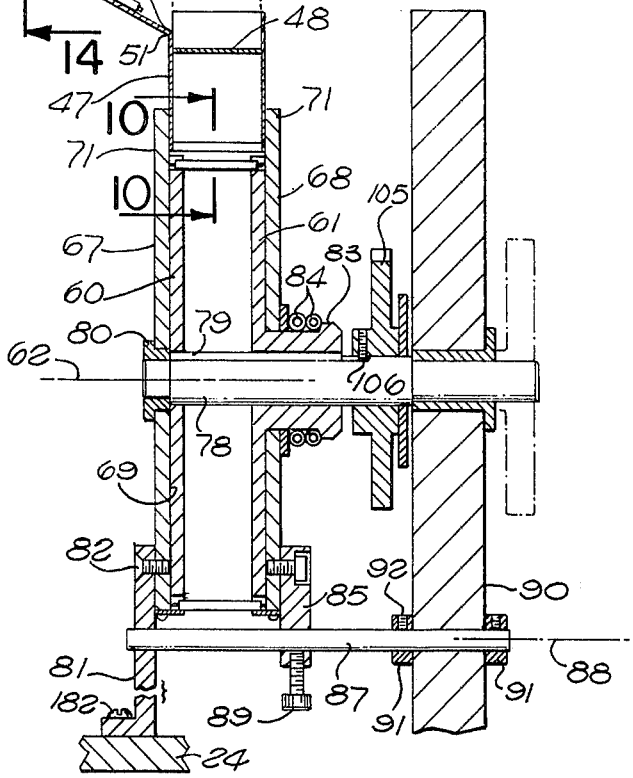
FIG. 5 is a fragmentary vertical section taken on line 5—5 of FIG. 2.

For confining the spring bars against axial movement as they are advanced by wheels 60 and 61, the transporter unit includes a pair of non-rotating plates 67 and 68 which are received at the outer sides of wheels 60 and 61, and have parallel vertical inner surfaces 69 and 70 disposed transversely of axis 62 and engaging the outer parallel planar surfaces of wheels 60 and 61 respectively. The plates 67 and 68 are circular about the entire periphery except at their upper extremities where they have projections 71 extending upwardly at opposite sides of hopper 16 to locate the hopper between those upper portions 71 as seen in FIG. 5. The circularly extending peripheral surfaces 72 which extend about plates 67 and 68 except at the locations of their upper projections 71 may be cylindrical about axis 62 and of a diameter correponding to the outer cylindrical surfaces 63 of wheels 60 and 61. Attached to these circular peripheral surfaces 72 of non-rotating plates 67 and 68, there are provided two strips of metal or other material 73, which extend arcuately about axis 62, and may be secured rigidly to peripheral surfaces 72 by screws 74 or other means. As seen in FIGS. 2 and 16, these retaining strips 73 project inwardly toward one another beyond inner surfaces of plates 67 and 68, to overlap the notched outer edges of wheels 60 and 61, and thus retain the spring bars 11 against movement radially outwardly from notches 64 and away from axis 62 at all locations between the opposite ends 75 and 76 of strips 73.

The wheel 61 and its non-rotating retaining plate 68 are mounted for axial adjustment relative to wheel 60 and its plate 67, and along a shaft 78 by which the wheels 60 and 61 are driven. Wheel 60 is secured in any suitable manner in fixed position relative to said shaft 78, and is connected to that shaft for rotation therewith by a key 79 (FIG. 5), while the associated non-rotating plate 67 journals the end of the shaft rotatively by a bearing represented at 80. The plate 67 is mounted in fixed position relative to base 24 of the machine, in any appropriate manner, as by attachment to a supporting plate 81 secured at its lower end by screws 182 to base plate 24 and projecting upwardly therefrom, and connected by screws 82 to plate 67.

The second wheel 61 is mounted for axial movement relative to wheel 60 by providing wheel 61 with an inner hub portion 83 which is movable axially along shaft 78 but is keyed thereto for rotation with shaft 78 by the previously mentioned axial key 79. Plate 68 is received about hub 83, and may be held against wheel 61 by annular coil springs 84 extending about the hub at the outer side of plate 68. Plate 68 may be retained against rotation about axis 62 by connection at its lower end to a part 85, through screws represented at 86, with this part 85 being slidable along a rod 87 whose axis 88 is parallel to rotary axis 62 of the wheels. A set screw 89 is tightenable against rod 87 to lock plate 68 and the connected wheel 61 in any desired set axial position. Rod 87 is rigidly connected at one end to the previously mentioned stationary part 81, and at its opposite end to a second vertical stationary mounting plate 90 secured at its lower end to base 24 of the machine. Lock rings 91 connected to rod 87 and received at opposite sides of vertical plate 90 may serve to lock the rod in set position by tightening of the set screws 92 of rings 91 against the rod.

Figure 6:
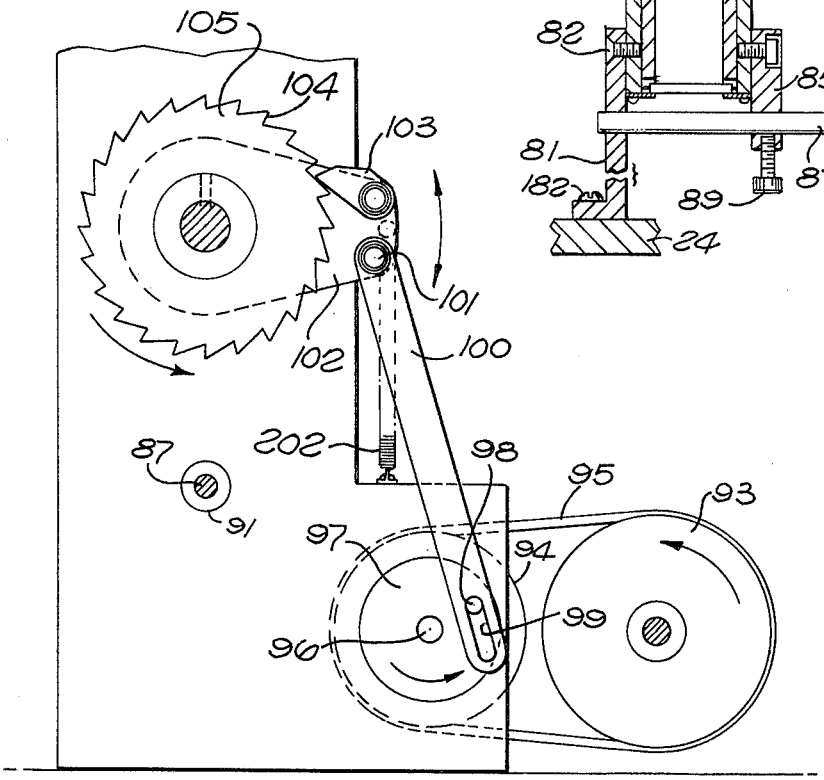
FIG. 6 is a vertical section taken on line 6—6 of FIG. 2.

Shaft 78 and the carried wheels 60 and 61 are driven rotatively in a step by step manner between successive positions in which the painting wheel 18 can contact and paint stripes on different ones of the spring bars 11 in different notches 64 of the transporter wheels. The drive for thus turning the shaft 78 is illustrated in FIGS. 2 and 6, and typically includes and electric motor 93, driving a pulley 94 through a belt 95, with the shaft 96 of pulley 94 carrying a continously rotating disc 97 having an eccentric pin 98 received in a slot 99 of a link 100. The upper end of this link 100 is pivotally connected at 101 to an arm 102 which is received pivotally about shaft 78 and is urged yieldingly in a clockwise direction as viewed in FIG. 6 by a spring 202, and which therefore oscillates upwardly and downwardly about the shaft as disc 97 turns continuously. A pawl 103 mounted pivotally to arm 102 is engageable with ratchet teeth 104 on a ratchet wheel 105 keyed to shaft 78 (as by set screw 106 represented in FIG. 5), so that each time the link 100 and arm 102 move upwardly in FIG. 6, they turn ratchet wheel 105 and shaft 78 through a predetermined angular distance, following which the elements 100 and 101 retract downwardly to engage the next successive tooth of the ratchet wheel in preparation for the next rotary advancing step of that wheel and the connected elements 60 and 61. The dimensions of the various parts are designed so that the amount of circular advancement of discs 60 and 61 on each such step corresponds to the radial distance between successive notches 64 on wheels 60 and 61.

Figure 4:
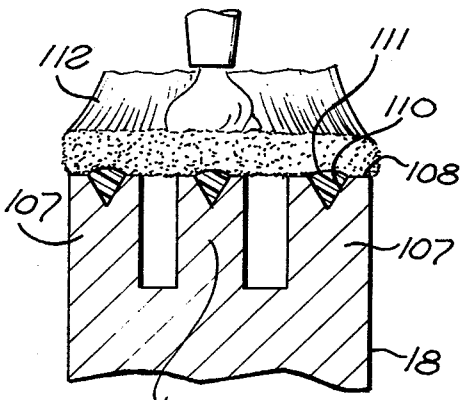
FIG. 4 is an enlarged fragmentary vertical section taken on line 4—4 of FIG. 3.

The machine includes several different paint wheels 18 which can be selectively connected to the apparatus at the position illustrated in FIGS. 2 and 3 for painting any desired number of stripes on the spring bars 11. Typically illustrated in FIG. 4 is a paint wheel designed for painting three stripes on each spring bar. For this purpose, the paint wheel 11 has three annular peripheral portions 107, whose outer surfaces 108 are circular about the axis 109 of wheel 18 and are aligned axially with one another, with each of these surfaces preferably containing a shallow annular groove 110 for receiving and holding a small amount of paint 111 to be applied to the spring bars. Paint is fed to the periphery of the wheel 18 in appropriate manner, desirably by positioning a paint brush 112 to engage the upper portion of wheel 18, with paint being dripped downwardly onto this brush from a feed tube 113 under the control of an adjustable valve 114 to which paint flows by gravity from an upper container 115.

Figure 11:
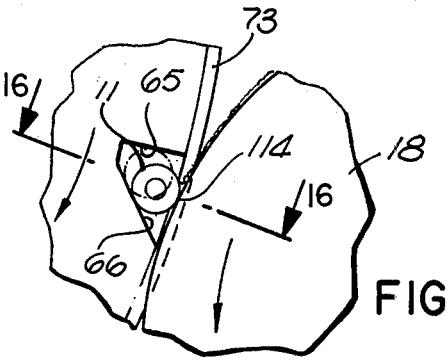
FIG. 11 is an enlarged fragmentary vertical section taken on line 11—11 of FIG. 2.
Figure 13:
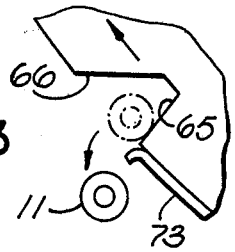
FIG. 13 is a fragmentary vertical section through the wheel assembly at the location at which the spring bars are discharged therefrom.
Figure 12:
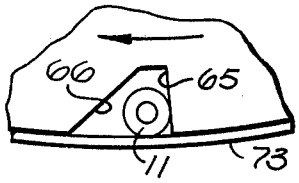
FIG. 12 is an enlarged fragmentary vertical section through a lower portion of the feed wheel assembly.

The paint wheel 18 is driven in a counterclockwise direction as viewed in FIG. 3, to carry the paint in grooves 110 from the upper brush location to a point 114 at which the paint wheel ca n contact a spring bar 11 at the location at which that spring bar is momentarily stopped for a painting operation by the step-by-step advancing mechanism. This painting position is illustrated in FIGS. 11 and 16, with the former of these figures showing the manner in which, at that painting location, the spring bar 11 can fall downwardly by gravity along inclined surfaces 66 of the notches 64, to advance radially outwardly by gravity away from axis 62 of wheels 60 and 61, and be held by gravity against the painting portions 108 of wheel 18. In this way, the spring bars are hald lightly against the painting wheel, without the necessity for provision of any springs or other means for urging the parts together during the painting operation.

Painting wheel 18 is driven rotatively about its axis 109 continuously so long as the machine is in operation. This drive can be effected by an electric motor 115 acting through a belt 116 to turn a pulley wheel 117, which in turn acts through a second belt 118 to drive a pulley 119 fixed to a shaft 120 to which the painting wheel 18 is detachably connectible by a set screw 218 or otherwise. The shaft 109 is mounted to an upstanding frame part 121 for relative upward and downward adjusting movement to a proper position relative to wheel 60 and 61, with this adjustable mounting being attained by connecting shaft 120 rotatably to a first end of an arm 122, whose second end is pivoted at 123 to support member 121. To assist arm 122 in rotatably mounting and locating shaft 120 and the carried painting wheel 18, a second and shorter arm 124 may extend parallel to arm 122, and be rigidly connected to arm 122 at 125, with shaft 120 being journalled in the second end of arm 124 at 126. As will be understood, the arms 122 and 124 are rigidly retained in fixed position, to effectively mount shaft 120 and wheel 18 for rotation about axis 109, while permitting the desired upward and downward adjusting movement of arms 122 and 124 and the carried rotary parts. This adjustment may be attained by provision of an adjusting screw 127, having its upper end rotatably connected at 128 to a member 129 projecting from frame element 121, and having its lower end threadedly engaging a part 130 connected to arm 122, so that rotation of the screw 127 will move the painting wheel 18 slightly upwardly or downwardly as desired.

To now summarize the operation of the machine, the first step in preparing the machine for painting stripes on a particular size and type of spring bar is to set the various adjustable portions of the machine for that particular bar unit. More particularly, a hopper 16 is selected which has a width dimension $x$ (FIG. 5) just slightly greater than the axial length of the type of spring bar which is to be painted, and that hopper with the attached chute 37 is connected to vibratory head 24 of the vibrating unit 15. The two screws 52 and 54 of FIG. 2 are utilized to attach this hopper and chute assembly at two locations to the vibrating head, to vibrate with that head. The lower end of the selected chute 16 is received between the upper portions 71 of the two plates 67 and 68 (FIG. 5), and with locking screw 89 loosened, the plate 68 and carried rotary wheel 61 are adjusted to positions in which the hopper is closely confined between the two plates 71 as seen in FIG. 5. Screw 89 is then tightened against rod 87, to lock the plates 71 and carried wheels 60 and 61 in these axially adjusted positions. A proper painting wheel 18 is selected, having a desired number of outer annular portions 107 for painting a selected number of stripes on the spring bars, and paint of a proper color is filled into the container 115.

With the apparatus thus prepared for operation, a supply of the spring bars of selected size are placed on the upper central surface 25 of the vibratory head, and the vibrator is then energized to commence helical advancement of the spring bars 11 upwardly along ramp 27. The motors 93 and 115 are energized, to commence step by step intermittent advancement of wheels 60 and 61 about their axis 62, and to commence continuous rotation of the painting wheel 18. With the parts in operation in this manner, the spring bars are fed successively downwardly along chute 37 and into hopper 16, for ultimate delivery through the lower portion of the hopper into positions in which the opposite ends of each spring bar are received within corresponding notches 62 in the two wheels 60 and 61. Each time that a pair of the notches 64 of wheels 60 and 61 are received directly beneath the bottom opening 45 of hopper 16, one of the spring bars falls into those notches. When the wheels 60 and 61 turn beyond this position in a clockwise direction as viewed in FIG. 3, the radially extending surfaces 65 of the notches cause corresponding rotary advancement of the engaged spring bar. As soon as the spring bar reaches the location 75 at the beginning of strips 73, the bar is effectively confined by those strips during advancement downwardly and then leftwardly in FIG. 3 to the location 76. Each of the spring bars stops at a location at which it tangentially contacts painting wheel 18, with the spring bar remaining in that position long enough for the rotating paint wheel 18 to turn the spring bar through at least one complete revolution about the axis of that bar, and thus paint the desired number of continuous circular stripes entirely about the bar. As the bars advance downwardly beyond the location of painting wheel 18, the quick drying paint sets rapidly, so that by the time it reaches the discharge location 76 at which the bars can move past the ends of strips 73 and fall downwardly, the paint is sufficiently dried to avoid smearing as a result of contact of the bars with one another or with other surfaces. The bars fall downwardly from the location 76 through an opening 131 in the bottom of base plate 24, and then fall through the previously mentioned flow of heated air in chute 20 as illustrated diagrammatically in FIG. 1, for accumulation within bin 22.

In addition to the various adjustments heretofore described, it is contemplated also that different pairs of the wheels 60 and 61 may be selectively connectible to shaft 78, with these different pairs of wheels having different sizes of notches 64 for receiving and holding spring bars or other elements having different diameters. To allow such change of the wheels 60 and 61, the screws 82 and 182 of FIG. 5 may be detachable to allow removal of plate 81 and non-rotating plate 67 with bearing 80, to thereby permit wheels 60 and 61 to be slipped leftwardly off of shaft 78 for replacement by different wheels with different dimensioned notches and with different non-rotating plates 67 and 68 if desired.

Though a typical embodiment of the invention has been shown and described in detail, it will of course be understood that the invention is not to be considered as limited to this particular form, but includes in addition all variations falling within the scope of the appended claims.

We claim:

1. Apparatus for painting coding markings on a series of elongated articles, comprising.

a transporting wheel structure mounted to turn about a predetermined axis and containing circularly spaced notches opening radially outwardly away from said axis and adapted to receive said articles in driving relation to advance them circularly as the structure turns;

means for feeding said articles successively into said notches at a predetermined pick-up location to be advanced circularly thereby to a painting location;

non-rotating retaining means relative to which said wheel structure turns and extending acruately about said axis and said wheel structure radially outwardly of and radially opposite said notches in a relation retaining said articles in said notches as the wheel structure turns relative to said retaining means:

said retaining means having two portions spaced axially apart at said painting location to engage one of said articles near opposite ends thereof while leaving an intermediate portion of the article exposed axially between said two portions of the retaining means; and painting means located adjacent said transporting wheel structure at said painting location and operable to paint markings on said exposed intermediate portion of the article between said spaced portions of the retaining means.

2. Apparatus as recited in claim 1, in which said two portions of said retaining means are relatively axially adjustably to differently spaced conditions for retaining opposite ends of articles of different lengths.

3. Apparatus as recited in claim 1, in which said transporting wheel structure includes two axially spaced wheels having said notches at corresponding locations for engaging said articles near opposite ends thereof, and adapted for relative axial adjusting movement to receive and retain articles of different lengths.

4. Apparatus as recited in claim 1, in which said transporting wheel structure includes two axially spaced wheels containing said notches at corresponding locations for receiving and holding said articles at opposite ends thereof, said two wheels and said two spaced portions of said retaining means both being relatively axially adjustable to receive and retain articles of different lengths.

5. Apparatus as recited in claim 4, in which said wheel structure turns about a generally horizontal axis and receives said articles from said feeding means at essentially the top of the wheel structure, said wheel structure being adapted to advance said articles downwardly past said painting means and then downwarly therebeyond, with said retaining means holding the articles in said notches in advance of and beyond said painting means to a discharge location at which said retaining means end and the notches open downwardly to permit the articles to fall therefrom.

6. Apparatus as recited in claim 5, in which said wheels have surfaces forming said notches and which engage said articles in supporting relation at said pick-up location, but are shaped and positioned to be inlined slightly downwardly when said surfaces reach or near said painting location, in a relation causing the engaged articles to move by gravity along said inclined surfaces away from said axis and against said painting means to be painted thereby.

7. Apparatus as recited in claim 6, in which there are two non-rotating plates disposed transversely of said axis at opposite sides of said wheels to retain said articles against movement axially out of said notches, said retaining means including two arcuate strips carried by said two plates respectively and projecting axially toward one another at locations radially outwardly of and opposite said notches to retain said articles therein, said plates being adjustable axially with said retaining means and in correspondence with axial adjustment of said wheels to enable said retention of articles of different lengths.

8. Apparatus as recited in claim 7, in which said feeding means include a unit for holding a supply of said articles and advancing them successively to a predetermined point, and a plurality of guides selectively connectible to said unit to receive said articles and each forming a guideway along which said articles fall to said pickup location for reception by the transporting wheel structure, said guides being of different widths to receive and guide articles of different lengths in the different adjusted positions of said wheels.

9. Apparatus as recited in claim 8, in which said guides have lower end portions received between said wheels.

10. Apparatus as recited in claim 1, in which said transporting wheel structure has a surface which engages said articles in supporting relation at said pick-up location, and which is shaped and positioned to be inclined slightly downwardly when said surface reaches or nears said painting location, in a relation causing an engaged article to move by gravity along said inclined surfaced away from said axis and toward said painting means to be painted thereby.

11. Apparatus as recited in claim 1, in which said transporting wheel structure includes two spaced wheels mounted to turn in unison and containing corresponding circularly spaced notches for receiving opposite ends of said articles, said feeding means including a guide for directing said articles successively to said pick-up location and having a portion received between said wheels.

* * * * *